US011641876B2

(12) United States Patent
Liu et al.

(10) Patent No.: US 11,641,876 B2
(45) Date of Patent: May 9, 2023

(54) INCLINED ULTRASONIC ATOMIZING SHEET STRUCTURE, ATOMIZER AND ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 937 days.

(21) Appl. No.: 16/462,858

(22) PCT Filed: Nov. 21, 2017

(86) PCT No.: PCT/CN2017/112129
§ 371 (c)(1),
(2) Date: May 21, 2019

(87) PCT Pub. No.: WO2018/095312
PCT Pub. Date: May 31, 2018

(65) Prior Publication Data

US 2020/0060336 A1 Feb. 27, 2020

(30) Foreign Application Priority Data

Nov. 22, 2016 (CN) ..... 201611046072.5

(51) Int. Cl.
*A24F 40/40* (2020.01)
*A24F 40/05* (2020.01)
(Continued)

(52) U.S. Cl.
CPC ..... *A24F 40/05* (2020.01); *A24F 40/40* (2020.01); *A24F 40/42* (2020.01); *A24F 40/46* (2020.01); *B05B 17/0615* (2013.01); *A24F 40/10* (2020.01)

(58) Field of Classification Search
CPC ..... A24F 40/40; A24F 40/42; A24F 40/46
See application file for complete search history.

(56) References Cited

U.S. PATENT DOCUMENTS

2016/0213866 A1* 7/2016 Tan ..... A61M 15/0085

FOREIGN PATENT DOCUMENTS

CN 204377937 U 6/2015
CN 105768238 A 7/2016
(Continued)

OTHER PUBLICATIONS

International Search Report issued in International Application No. PCT/CN2017/112129 dated Feb. 26, 2018, 4 pages.

*Primary Examiner* — Eric Yaary
(74) *Attorney, Agent, or Firm* — Mauriel Kapouytian Woods LLP; Liang Huang

(57) ABSTRACT

Disclosed are an inclined ultrasonic atomizing sheet structure, an atomizer and an electronic cigarette. The inclined ultrasonic atomizing sheet structure comprises atomization cotton and an ultrasonic atomizing sheet. The ultrasonic atomizing sheet is obliquely arranged relative to the horizontal plane, and two ends of the atomization cotton are used for connecting to tobacco tar in a tobacco tar cavity via tobacco tar guide cotton, or the two ends of the atomization cotton are directly arranged in the tobacco tar cavity. A lower
(Continued)

surface of the atomization cotton is in contact with an atomization surface of the ultrasonic atomizing sheet. The ultrasonic atomizing sheet structure can prevent the ultrasonic atomizing sheet from being soaked in the tobacco tar and thus prevent the situation that smoke cannot be produced by atomization.

20 Claims, 7 Drawing Sheets

(51) Int. Cl.

| | |
|---|---|
| ***B05B 17/06*** | (2006.01) |
| ***A24F 40/42*** | (2020.01) |
| ***A24F 40/46*** | (2020.01) |
| *A24F 40/10* | (2020.01) |

(56) References Cited

FOREIGN PATENT DOCUMENTS

| | | | | | |
|---|---|---|---|---|---|
| CN | 105876870 | A | | 8/2016 | |
| CN | 105876873 | A | * | 8/2016 | ..... A24F 40/05 |
| CN | 205432143 | U | | 8/2016 | |
| CN | 206197036 | U | | 5/2017 | |
| KR | 20130006714 | U | | 11/2013 | |

* cited by examiner

INCLINED ULTRASONIC ATOMIZING SHEET STRUCTURE, ATOMIZER AND ELECTRONIC CIGARETTE

CROSS REFERENCE TO RELATED APPLICATIONS

This application is a national phase application of international application number PCT/CN2017/112129 filed on Nov. 21, 2017, which claims priority to Chinese application number 201611046072.5 filed on Nov. 22, 2016. The entire contents of these applications are hereby incorporated herein by reference.

FIELD OF THE INVENTION

The present invention relates to an inclined ultrasonic atomizing sheet structure, an atomizer and an electronic cigarette, and belongs to the field of electronic cigarettes.

BACKGROUND OF THE INVENTION

Tobacco tar is heated by a heating wire in the conventional atomizer. The tobacco tar or liquid is guided onto the heating wire by tobacco tar guide cotton or fiber. When the temperature of the heating wire is too high, the tobacco tar guide material such as the tobacco tar guide cotton or fiber is likely to burn out to produce harmful substances to harm the health of a smoker, and the burnt flavour is easily produced to affect the smoking taste. In addition, part of the heat of the heating wire is absorbed by the tobacco tar guide material, resulting in heat transfer loss, high power consumption and low efficiency, and causing the atomizer to burn hot.

Chinese patent application for invention CN201610160216.3 disclosed an ultrasonic atomizer and an electronic cigarette, wherein the ultrasonic atomizer comprises an atomizing sheet and a liquid guide structure for guiding liquid onto the upper surface of the atomizing sheet; the liquid guide structure is communicated with a liquid storage cavity; the upper surface of the atomizing sheet is communicated with an airflow channel; and the atomizing sheet comprises a piezoelectric ceramic layer and an electric conductor for driving the piezoelectric ceramic layer to vibrate. The atomizing sheet of the present invention does not need to be provided with micropores to spray the atomizing gas, thus avoiding the situation that the atomizing gas cannot be sprayed because large atomizing gas particles block the micropores, and better preventing the atomizer from leaking liquid.

However, in the disclosed Chinese patent application CN201610160216.3, the piezoelectric ceramic is placed horizontally, and after the atomizer is placed for a period of time, the atomization surface of the piezoelectric ceramic is full of tobacco tar, so that the piezoelectric ceramic starts atomizing of the tobacco tar slowly, even smoke cannot be produced by atomization, and at the same time, the tobacco tar leaks or is sucked. Thus, smoke is produced only after excess tobacco tar on the atomization surface of the piezoelectric ceramic is cleaned by disassembly, which brings inconvenience to use and poor experience and needs to be urgently improved.

SUMMARY OF THE INVENTION

The present invention aims to provide an inclined ultrasonic atomizing sheet structure, an atomizer and an electronic cigarette. The ultrasonic atomizing sheet structure can prevent the atomizing sheet from being soaked in tobacco tar such that no smoke is produced by atomization. Further, the present invention can also avoid the phenomenon of leakage and suction of tobacco tar and the poor experience.

In order to achieve the above objective, the technical solution adopted by the present invention is:

An inclined ultrasonic atomizing sheet structure, comprising atomization cotton and an ultrasonic atomizing sheet; wherein the ultrasonic atomizing sheet is obliquely arranged, and two ends of the atomization cotton are used for connecting to tobacco tar in a tobacco tar cavity via tobacco tar guide cotton, or the two ends of the atomization cotton are directly provided in the tobacco tar cavity; and a lower surface of the atomization cotton is in contact with an atomization surface of the ultrasonic atomizing sheet.

Thus, the ultrasonic atomizing sheet is obliquely arranged relative to the horizontal plane when the electronic cigarette is used. The two ends of the atomization cotton are in contact with the tobacco tar guide cotton or directly stretch into the tobacco tar cavity to realize a tobacco tar guide function. When the atomizer is in operation, sufficient tobacco tar supply is ensured; when the atomizer is not in operation, the excess tobacco tar on the ultrasonic atomizing sheet is returned to the tobacco tar guide cotton or the tobacco tar cavity through the atomization cotton at the lower end of the inclined portion, so that the surface of the ultrasonic atomizing sheet is not soaked in the tobacco tar, and a sufficient amount of tobacco tar is supplied for atomization.

According to the embodiments of the present invention, the present invention may be further optimized. The following shows technical solutions formed after optimization:

Preferably, the ultrasonic atomizing sheet is a piezoelectric ceramic driven by an electric conductor to ultrasonically vibrate.

Preferably, the ultrasonic atomizing sheet has an inclination angle of A, wherein $0° < A < 90°$, more preferably, $50° \leq A \leq 75°$. Tests have proved that the effect of the inclination angle of 50°-75° is preferred.

According to a first embodiment of the present invention, the ultrasonic atomizing sheet is arranged in a mounting cavity of a housing, and the mounting cavity is obliquely arranged; preferably, the ultrasonic atomizing sheet is arranged in the mounting cavity through a silica gel sleeve, the bottom of the mounting cavity is provided with a penetration groove, and the lower part of the atomization cotton penetrates through the penetration groove and is connected to the tobacco tar guide cotton.

In order to lock the tobacco tar guide cotton on the housing, a locking ring fixedly connected with the housing is arranged at the upper part of the tobacco tar guide cotton, an air tube for communicating with a suction nozzle is formed in the center of the locking ring, an air passing slot is formed in the outer wall of the locking ring, and the air passing slot is used for forming an air inflow passage between the outside and the atomization cotton.

A gap is formed between the bottom of the air tube of the locking ring and the upper surface of the atomization cotton; preferably, the width of the gap is 0.2 to 5 mm; more preferably, the width of the gap is 0.5 to 2.5 mm. Thus, it can be ensured that most of airflow passes over the surface of the atomization cotton and carries the ultrasonically atomized smoke away.

In order to prevent a gap between the atomization cotton and the atomization surface of the ultrasonic atomizing sheet from affecting the atomization effect of tobacco tar, a pressing structure which maintains contact between the atomization cotton and the atomization surface of the ultrasonic atomizing sheet is arranged on the upper surface of the atomization cotton; preferably, the pressing structure is a pressing spring. The pressing spring can always ensure that the atomization cotton fits the atomization surface of the ultrasonic atomizing sheet.

According to another embodiment of the present invention, the ultrasonic atomizing sheet is arranged at the top of an atomizing seat, and a silica gel seat is arranged on the upper surface of the ultrasonic atomizing sheet; an air outlet is formed in the center of the silica gel seat, and an air inlet is formed at the lower part of the silica gel seat; the air outlet is used for communicating with the suction nozzle, and the air inlet is used for forming an air inflow passage between the outside and the atomization cotton. Since the ultrasonic atomizing sheet is obliquely placed, the ultrasonic atomizing sheet in operation ejects the smoke formed by atomization of the tobacco tar to the inner wall of the air outlet, the inner wall collects and condenses large-particle smoke into smoke droplets, and the smoke droplets drop onto the atomization cotton along the inner wall and are re-atomized. During this process, small-particle smoke is sucked by the user to prevent the large-particle smoke from being sucked to affect the taste of the smoke.

Preferably, the bottom of the silica gel seat is provided with a ventilation groove which is used for communicating the air outlet with the air inflow passage.

In order to ensure that the atomization cotton can better deliver the tobacco tar to the atomization surface of the ultrasonic atomizing sheet, the two ends of the atomization cotton pass through the gap between the atomizing seat and the silica gel seat and stretch into the tobacco tar cavity.

Based on the same inventive concept, the present invention further provides an atomizer, including a housing and a suction nozzle; wherein the inclined ultrasonic atomizing sheet structure is arranged in the housing;

Two ends of the atomization cotton are connected to the tobacco tar in the tobacco tar cavity through the tobacco tar guide cotton, or the two ends of the atomization cotton are directly arranged in the tobacco tar cavity.

According to a first embodiment of the present invention, a locking ring fixedly connected with the housing is arranged at the upper part of the tobacco tar guide cotton; the housing and the locking ring are detachably and fixedly connected, and the housing and the suction nozzle are also detachably and fixedly connected; preferably, the internal thread of the housing is connected to the external thread of the locking ring, and the external thread of the housing is connected to the internal thread of the suction nozzle.

An air tube is formed in the center of the locking ring, and the air tube and the hollow passage of the suction nozzle form an air outflow passage; an air inlet slot is formed between the housing and the suction nozzle, an air passing slot is formed in the outer wall surface of the locking ring, and the air inlet slot and the air passing slot form an air inflow passage which communicates with the air outflow passage.

In order to facilitate the removal and cleaning or replacement of the suction nozzle, the housing and the suction nozzle are detachably and fixedly connected; preferably, the internal thread of the housing is connected to the external thread of the suction nozzle. The removal and installation are more convenient and rapid by means of threaded connection.

According to another embodiment of the present invention, a silica gel seat and an atomizing seat are arranged in the housing, and the ultrasonic atomizing sheet and the atomization cotton are arranged between the silica gel seat and the atomizing seat; an air outlet is formed in the center of the silica gel seat, and an air inlet is formed at the lower part of the silica gel seat; the air outlet communicates with the suction nozzle to form an air outflow passage, and the air inlet and the ventilation groove at the bottom of the silica gel seat form an air inflow passage which communicates with the air outflow passage.

Based on the same inventive concept, the present invention further provides an electronic cigarette, including a battery assembly and the atomizer; wherein the battery assembly is used for driving the ultrasonic atomizing sheet to ultrasonically vibrate through a battery; and the ultrasonic atomizing sheet of the atomizer is obliquely arranged relative to the horizontal plane when the electronic cigarette is used.

In order to facilitate adding of tobacco tar, the atomizer is detachably and fixedly connected to the battery assembly, and preferably, the atomizer is magnetically connected to the battery assembly.

In order to prevent a battery cover from scalding hands when the atomizer is in operation, the battery assembly includes a battery cover, a large bracket and a battery; and a heat insulation space is formed in the large bracket. The heat insulation space improves the user experience.

Preferably, an upper fixing cover is arranged at the bottom of the housing, a lower fixing cover is arranged at the top of the battery cover, an upper electrode is mounted on the upper fixing cover, a lower electrode is mounted on the lower fixing cover, and the upper electrode is electrically connected with the lower electrode; a key is mounted on a side face of the battery cover, a PCB (Printed Circuit Board) is arranged inside the key, the battery is electrically connected with the PCB, and the PCB is in contact with the lower electrode when the PCB 24 is pressed by the key 23.

With the above structure, the inclined piezoelectric ceramic is placed in the electronic cigarette atomizer at an inclination angle of A, wherein $90°<A<0°$, and since the angle is an inclination angle, the piezoelectric ceramic is at different heights on two sides, and the atomization cotton is arranged from the high side to the low side. Thus, when being guided, the tobacco tar passes through the atomization cotton to reach the surface of the piezoelectric ceramic for atomization. When the inclined atomization cotton sucks the tobacco tar to be saturated, no excess tobacco tar is produced to soak the atomization surface of the piezoelectric ceramic, so the problems that the piezoelectric ceramic soaked in the tobacco tar is started slowly and the amount of smoke is small are solved, and the user experience is improved.

Compared with the prior art, the present invention has the following advantages:

1. An inclined ultrasonic atomizing sheet is arranged in the atomizer, and the ultrasonic atomizing sheet is a solid piezoelectric ceramic; the inclination angle is A, wherein $0°<A<90°$, preferably $50°\leq A\leq 75°$; by setting A within this angle range, two ends of the atomization cotton are in contact with the tobacco tar guide cotton or directly stretch into the tobacco tar cavity to realize a tobacco tar guide function; when the atomizer is in operation, sufficient tobacco tar supply is ensured; when the atomizer is not in operation, excess tobacco tar on the ultrasonic atomizing sheet is returned to the tobacco tar guide cotton or the tobacco tar cavity through the atomization cotton at the lower end of the inclined portion, so that the surface of the piezoelectric ceramic is not soaked in the tobacco tar, and a sufficient amount of tobacco tar is supplied for atomization.

2. The tobacco tar is transferred to the atomization cotton through the tobacco tar guide cotton, and then the piezoelectric ceramic can atomize the tobacco tar in the atomization cotton to produce smoke, thus well controlling the flow rate of the tobacco tar to affect the atomization rate.

3. The atomization cotton is in contact with a part of the surface of the piezoelectric ceramic to improve the operating rate of the piezoelectric ceramic, thereby improving the user experience.

4. The atomizer is magnetically connected with the battery to facilitate disassembly.

5. The suction nozzle can be removed for cleaning.

6. A large bracket is arranged in the battery assembly, and a heat insulation space is formed in the large bracket, thus preventing the heat generated by the battery assembly from being transferred to the battery cover to scald hands when the electronic cigarette is in operation.

1-atomizer; 2-battery assembly; 11-suction nozzle; 12-locking ring; 13-pressing spring; 14-atomization cotton; 15-silica gel sleeve; 16-piezoelectric ceramic; 17-tobacco tar guide cotton; 18-housing; 19-upper fixing cover: 20-upper electrode; 21-lower fixing cover; 22-lower electrode; 23-key; 24-PCB; 25-large bracket; 26-battery cover; 27-battery; 28-charging assembly; 29-heat insulation space: 30-air inlet slot: 31-air groove; 32-air passing slot; 33-air port; 34-mounting cavity; 35-penetration groove; 36-connecting electrode; 37-atomizing seat; 38-silica gel seat; 39-air outlet; 40-air outlet; 41-support pillar: 42-ventilation groove.

DETAILED DESCRIPTION OF THE EMBODIMENTS

The present invention will be described in detail below with reference to the accompanying drawings in combination with embodiments. It should be noted that the embodiments in the present invention and the features in the embodiments can be combined with each other without conflicts. For ease of narrative, the terms "upper", "lower", "left" and "right" described below are only consistent with the upper, lower, left and right directions of the drawings, and do not limit the structure.

Embodiment 1

Figure 3:
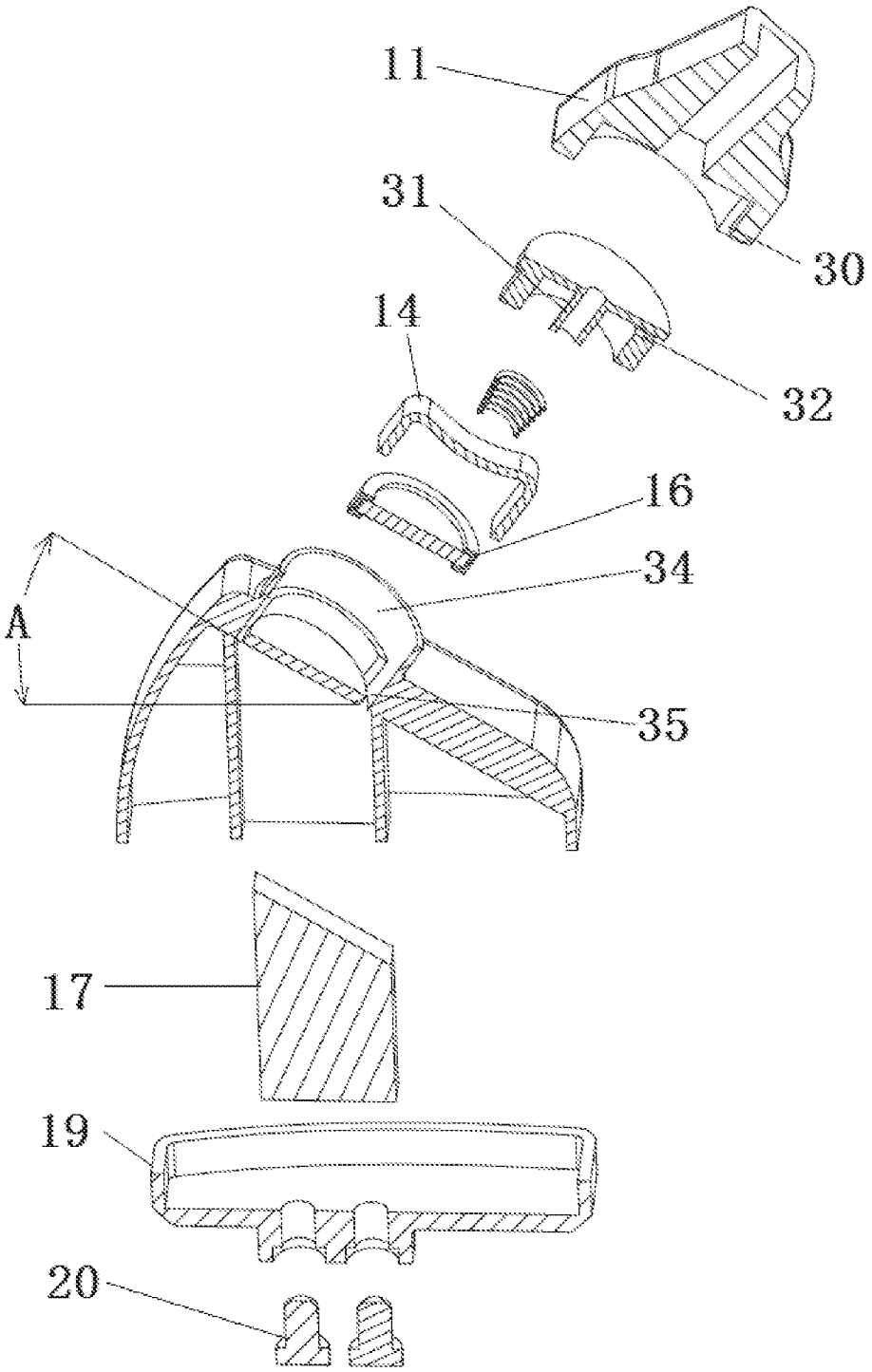
FIG. 3 is an exploded cross-sectional view of an atomizer in FIG. 1.

An inclined ultrasonic atomizing sheet structure, as shown in FIG. 3, includes atomization cotton 14, a piezoelectric ceramic 16, and tobacco tar guide cotton 17. The lower end of the tobacco tar guide cotton 17 is immersed in a tobacco tar cavity, and two ends of the atomization cotton 14 are in contact with the tobacco tar guide cotton 17, so that the tobacco tar is transferred to the atomization cotton 14 through the tobacco tar guide cotton 17, and then the piezoelectric ceramic 16 can atomize the tobacco tar in the atomization cotton 14 to produce smoke, thus well controlling the flow rate of the tobacco tar to affect the atomization rate.

The atomization cotton 14 of the present invention is pressed on an atomization surface of the piezoelectric ceramic 16 through a pressing spring 13, thus avoiding poor contact between the atomization cotton 14 and the piezoelectric ceramic 16 due to vibration of the piezoelectric ceramic 16 in operation of the atomizer, thus the atomization effect or life of the piezoelectric ceramic 16 cannot be affected.

The piezoelectric ceramic 16 of the present invention is a solid piezoelectric ceramic, which is driven by an electric conductor to form an ultrasonic atomizing sheet. The piezoelectric ceramic 16 of the present invention is obliquely arranged at an inclination angle of A, preferably, $0° < A < 90°$, and more preferably, $50° \leq A \leq 75°$.

Within this angle range, two ends of the atomization cotton are in contact with the tobacco tar guide cotton to realize a tobacco tar guide function. When the atomizer is in operation, sufficient tobacco tar supply is ensured. When the atomizer is not in operation, excess tobacco tar on the piezoelectric ceramic is returned to the tobacco tar guide cotton through the atomization cotton at the lower end of the inclined portion, so that the surface of the piezoelectric ceramic is not soaked in the tobacco tar, and a sufficient amount of tobacco tar is supplied for atomization.

A piezoelectric ceramic mounting cavity 34 for placing the piezoelectric ceramic 16 in a housing 18 is also arranged obliquely. A penetration groove 35 is formed all around the bottom of the piezoelectric ceramic mounting cavity 34, and the atomization cotton 14 penetrates through the penetration groove 35 and is in contact with the tobacco tar guide cotton 17 to supply enough tobacco tar for the ultrasonic atomizing sheet.

Figure 2:
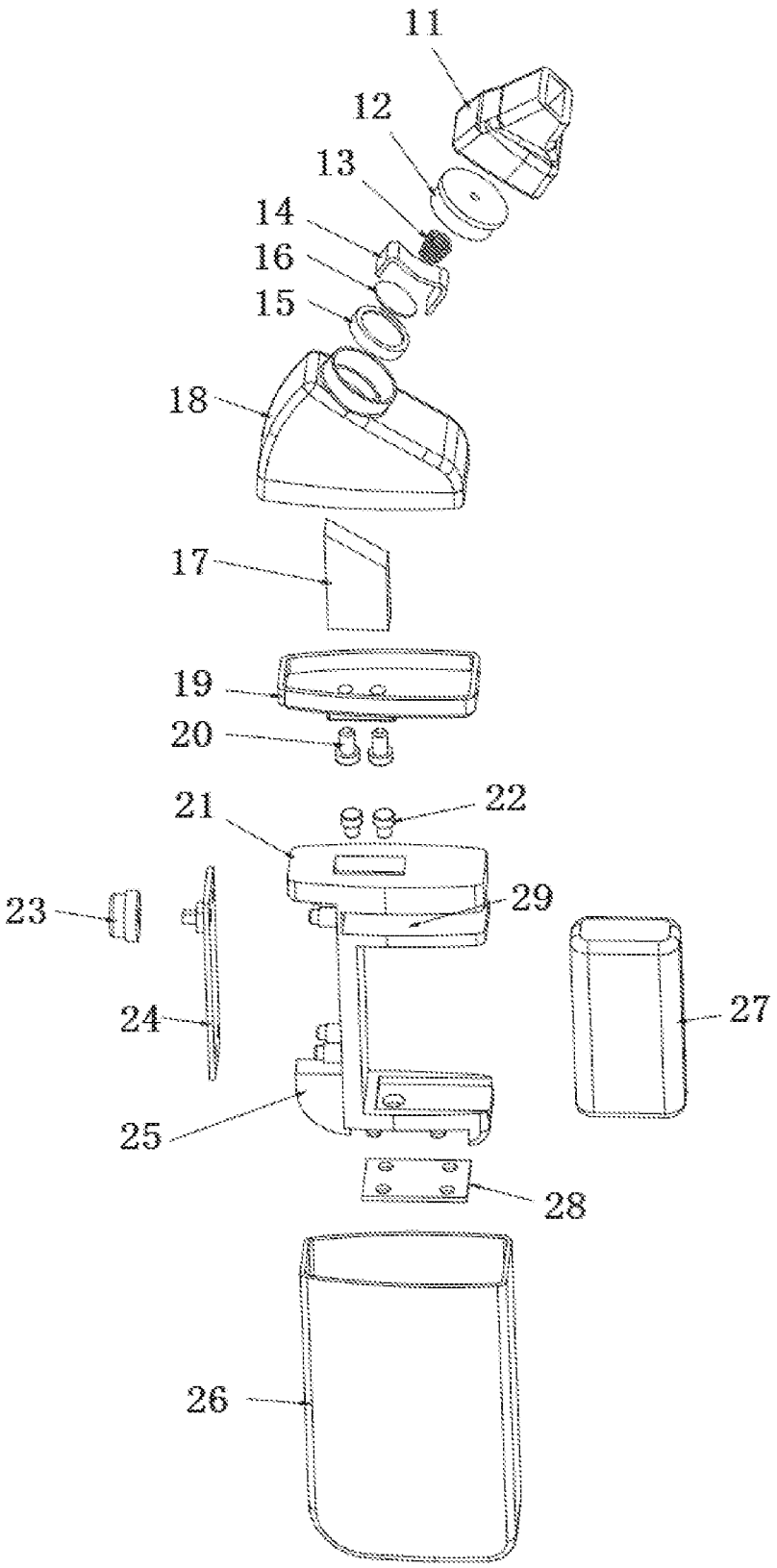
FIG. 2 is an exploded schematic view of FIG. 1.

The atomization cotton of the present invention is in contact with a part of the surface of the piezoelectric ceramic to improve the operating rate of the piezoelectric ceramic, thereby improving the user experience. An atomizer, as shown in FIG. 2 and FIG. 3, includes a suction nozzle 11 and a housing 18. A tobacco tar cavity is formed in the housing 18. The tobacco tar in the tobacco tar cavity enters the atomization cotton 14 through the tobacco tar guide cotton 17, the atomization cotton 14 delivers the tobacco tar to the atomization surface of the piezoelectric ceramic being as an ultrasonic atomizing sheet for atomization, and the atomized smoke is sucked by a smoker through the air outflow passage of the suction nozzle.

The internal thread of the housing 18 is connected with a locking ring 12, and the external thread of the housing 18 is connected with the suction nozzle 11. The suction nozzle 11 of the present invention can be removed for cleaning.

An air tube 31 communicated with a suction passage is arranged in the center of the locking ring 12, an air passing slot 32 is formed in a side wall of the locking ring 12, an air inlet slot 30 is formed between the suction nozzle 11 and the housing 18, and the air inlet slot 30 is communicated with the air passing slot 32.

The air tube 31 of the present invention is not in contact with the surface of the atomization cotton 14, and the distance between the air tube 31 and the atomization cotton 14 is preferably 0.2 to 5 mm, ensuring that most of airflow passes through the surface of the atomization cotton 14 and carries the ultrasonically atomized smoke away.

The lower end of the tobacco tar guide cotton 17 of the present invention is in contact with the tobacco tar in the tobacco tar cavity, so that the tobacco tar can be absorbed by the tobacco tar guide cotton 17.

In the present invention, the piezoelectric ceramic 16 is obliquely arranged, preferably at an inclination angle of more than or equal to 50° and less than or equal to 75° relative to the horizontal plane. Within this angle range, the two ends of the atomization cotton 14 are in contact with the tobacco tar guide cotton 17 to realize a tobacco tar guide function. When the atomizer 1 is in operation, sufficient tobacco tar supply is ensured. When the atomizer 1 is not in operation, excess tobacco tar on the piezoelectric ceramic 16 is returned to the tobacco tar guide cotton 17 through the atomization cotton 14 at the lower end of the inclined portion, thus preventing the piezoelectric ceramic 16 from being soaked in the tobacco tar.

Figure 1:
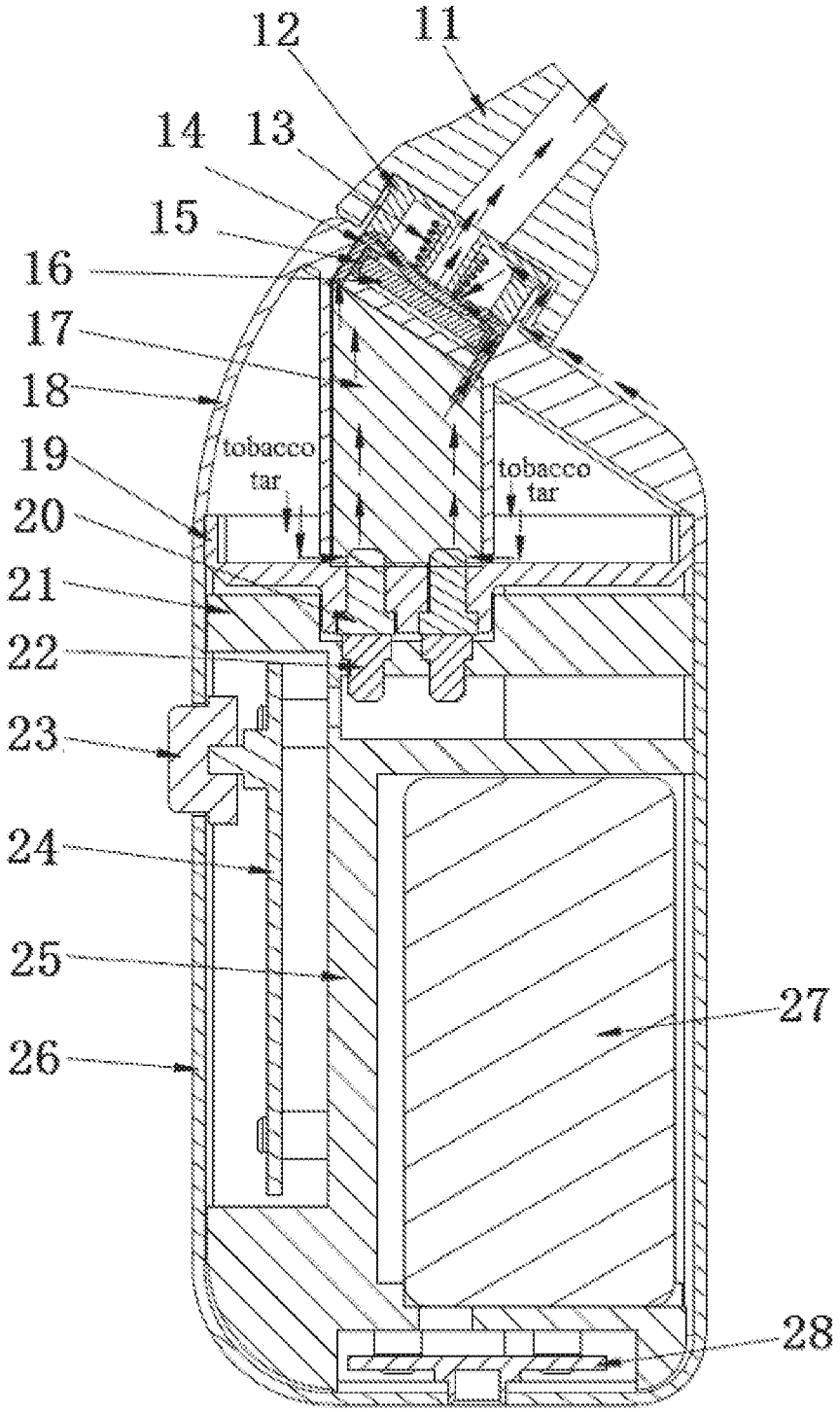
FIG. 1 is a structural principle diagram according to Embodiment 1 of the present invention.
Figure 4:
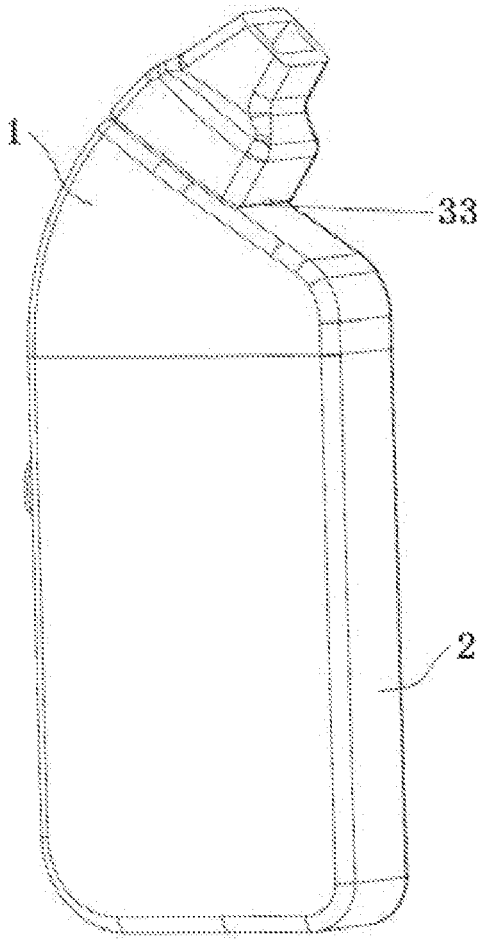
FIG. 4 is a three-dimensional view of FIG. 1.

An electronic cigarette, as shown in FIG. 1 and FIG. 4, includes the above atomizer 1 and a battery assembly 2, wherein the atomizer 1 is magnetically connected with the battery assembly 2 to facilitate disassembly.

The battery assembly of the present invention includes a battery cover 26, a large bracket 25, and a battery 27. A heat insulation space 29 is formed in the large bracket 25 to prevent the heat generated by the battery assembly 2 from being transferred to the battery cover 26 to scald hands when the electronic cigarette is in operation.

An upper fixing cover 19 is arranged at the bottom of the housing 18, a lower fixing cover 21 is arranged at the top of the battery cover 26, an upper electrode 20 is mounted on the upper fixing cover 19, a lower electrode 22 is mounted on the lower fixing cover 21, and the upper electrode 20 is electrically connected with the lower electrode 22. A key 23 is mounted on a side face of the battery cover 26, a PCB (Printed Circuit Board) 24 is arranged inside the key 23, the battery 27 is electrically connected with the PCB 24, and the PCB 24 is in contact with the lower electrode 22 when the PCB 24 is pressed by the key 23, so that the battery 27 supplies power to the piezoelectric ceramic being as an ultrasonic atomizing sheet for ultrasonic atomization.

A charging assembly 28 for charging the battery 27 is mounted at the bottom of the battery cover 26.

Embodiment 2

Figure 7:
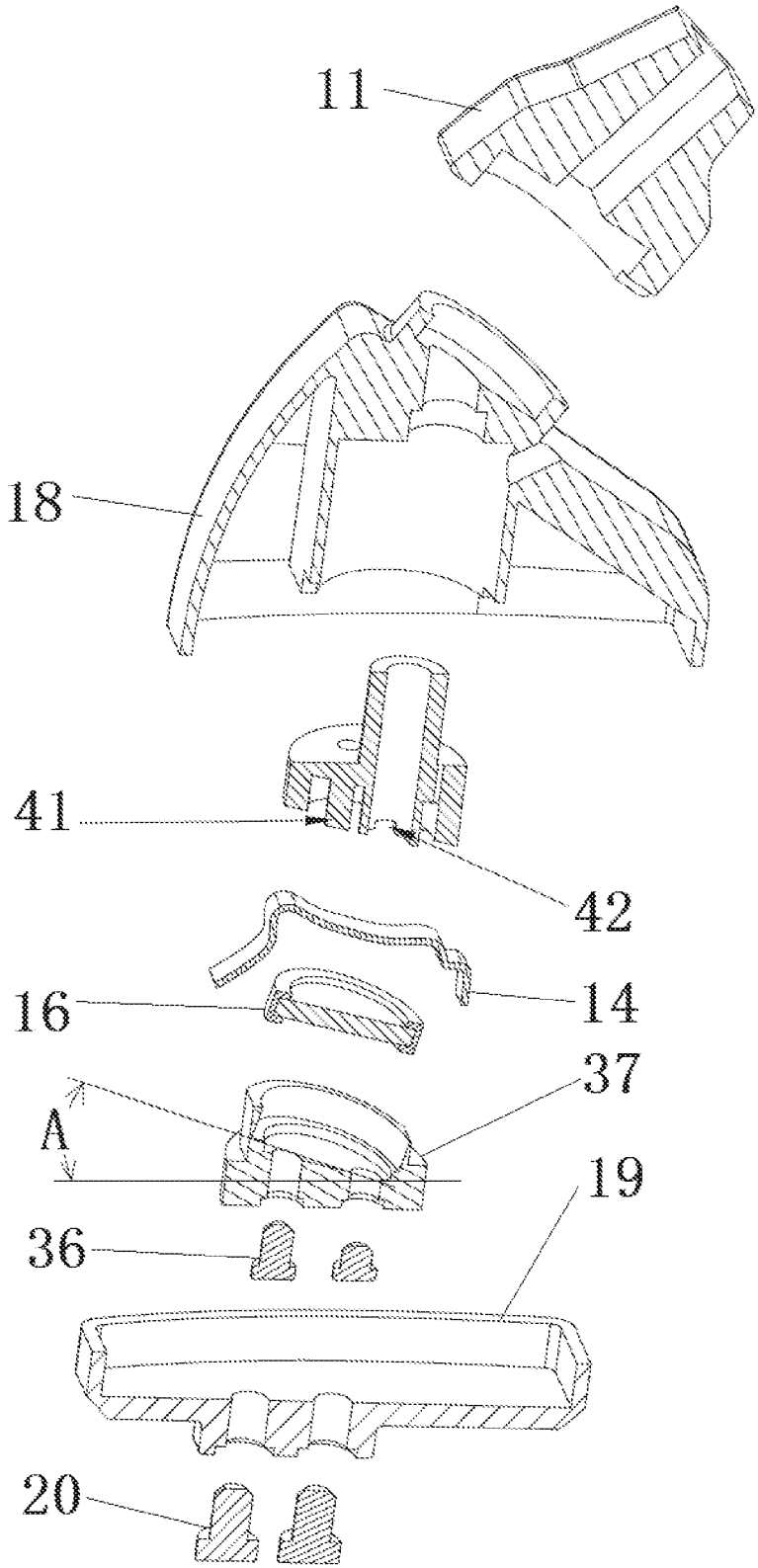
FIG. 7 is an exploded cross-sectional view of the atomizer in FIG. 5.

An inclined ultrasonic atomizing sheet structure, as shown in FIG. 7, includes atomization cotton 14 and a piezoelectric ceramic 16. Two ends of the atomization cotton 14 are directly immersed in the tobacco tar cavity, the tobacco tar is transferred to the piezoelectric ceramic 16 by the atomization cotton 14, and the tobacco tar in the atomization cotton 14 is atomized to produce smoke, thus well controlling the flow rate of the tobacco tar to affect the atomization rate.

The atomization cotton 14 of the present invention is pressed on an atomization surface of the piezoelectric ceramic 16 through a silica gel seat 13, thus avoiding poor contact between the atomization cotton 14 and the piezoelectric ceramic 16 due to vibration of the piezoelectric ceramic 16 in operation of the atomizer 1.

The piezoelectric ceramic 16 of the present embodiment is similar to the ultrasonic atomizing sheet in Embodiment 1, and is driven by an electric conductor to form an ultrasonic atomizing sheet to atomize the tobacco tar. The piezoelectric ceramic 16 of the present invention is obliquely arranged at an inclination angle of A. Preferably, $0<A<90°$, and more preferably, $50°\leq A\leq 75°$. Within this angle range, two ends of the atomization cotton are directly immersed in a tobacco tar cavity to realize a tar guide function. When the atomizer is in operation, sufficient tar supply is ensured. When the atomizer is not in operation, excess tobacco tar on the piezoelectric ceramic is returned to the tobacco tar cavity through the atomization cotton at the lower end of the inclined portion, so that the tobacco tar on the atomization cotton is saturated, the surface of the piezoelectric ceramic does not accumulate the tobacco tar or is not soaked in the tobacco tar, and a sufficient amount of tobacco tar is supplied for atomization.

An air outlet 39 communicated with a suction passage and an air inlet 40 communicated with the atomization surface of the atomization cotton 14 are formed in the center of the silica gel seat 13 of the present embodiment, and the air inlet 40 is communicated with the air outlet 39 through a ventilation groove 42. Thus, the silica gel seat 13 is provided with an air inlet 40, and the airflow enters the atomization surface of the piezoelectric ceramic 16 through the air inlet 40, and then the smoke is discharged from the air outlet of the silica gel seat 40.

An atomizing seat 37 is mounted in the housing 18. The atomizing seat 37 is provided with a piezoelectric ceramic mounting cavity 34 for placing the piezoelectric ceramic 16. The atomization cotton 14 passes through the gap between the atomizing seat 37 and the silica gel seat 13, and the two ends of the atomization cotton 14 are in contact with the tobacco tar in the tobacco tar cavity, so that a sufficient amount of tobacco tar can be supplied to the ultrasonic atomizing sheet. The atomizing seat 37 is provided with an inclined cavity for placing the piezoelectric ceramic 16 at an inclination angle of A, $0°<A<90°$, preferably $50°\leq A\leq 75°$. Within this angle range, the two ends of the atomization cotton are directly immersed in the tobacco tar cavity to realize a tobacco tar guide function. When the atomizer is in operation, sufficient tobacco tar supply is ensured. When the atomizer is not in operation, excess tobacco tar on the piezoelectric ceramic is returned to the tobacco tar cavity through the atomization cotton at the lower end of the inclined portion, thus preventing the piezoelectric ceramic from being soaked in the tobacco tar.

The atomization cotton 14 of the present invention is in contact with a part of the surface of the piezoelectric ceramic to improve the operating rate of the piezoelectric ceramic, thereby improving the user experience. The top of the atomization cotton 14 is pressed by a support pillar 41 arranged at the lower part of the silica gel seat 13, thereby preventing the atomization cotton 14 from being separated from the piezoelectric ceramic 16 to affect the atomization effect. The support pillar 41 abuts against the atomization cotton 14. When the piezoelectric ceramic 16 is in operation, the atomization cotton 14 is kept in contact with the piezoelectric ceramic 16, thereby increasing the atomization effect, and preventing the atomization cotton from being sucked up by smoking force to separate from the piezoelectric ceramic.

Figure 6:
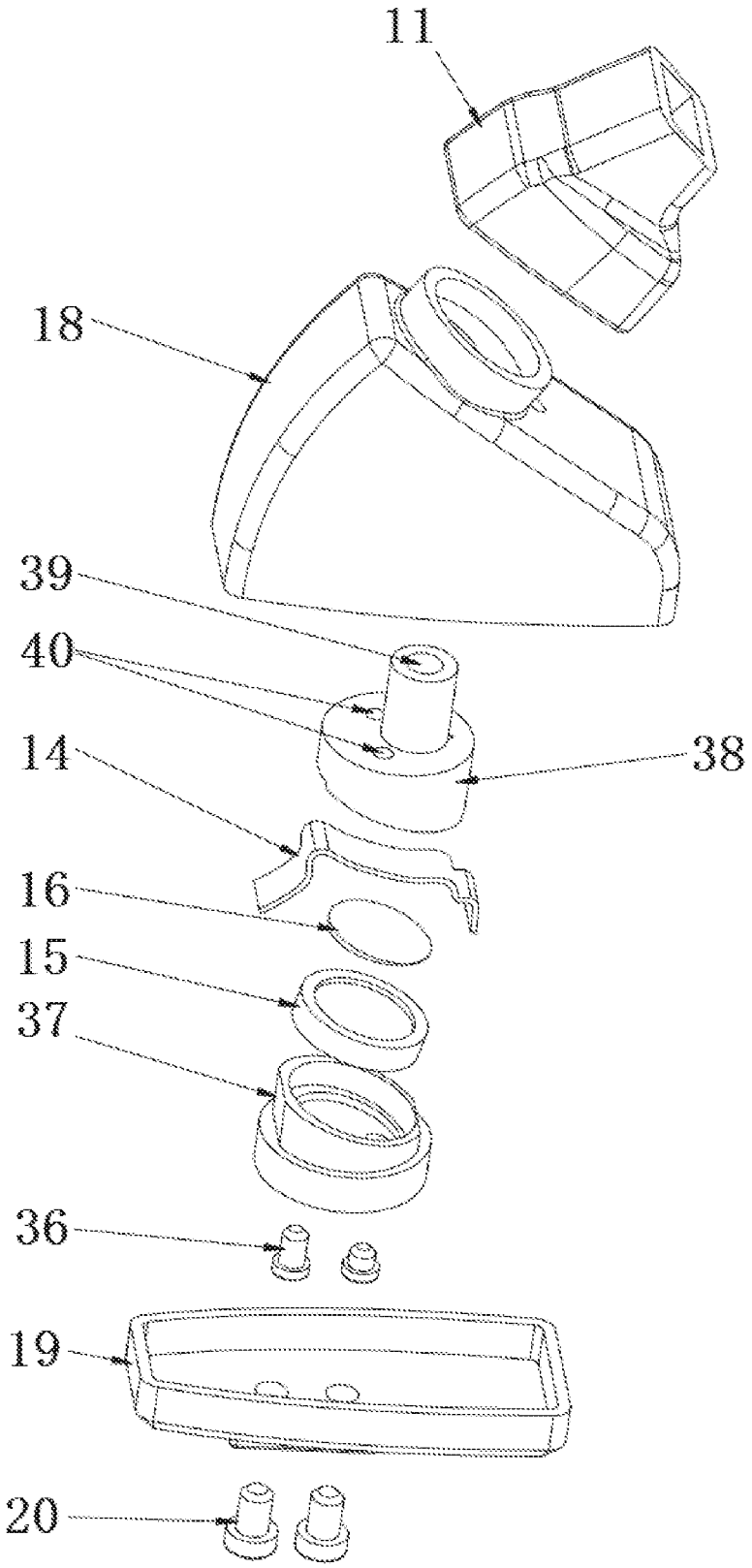
FIG. 6 is an exploded schematic view of an atomizer in FIG. 5.

An atomizer, as shown in FIGS. 6 and 7, includes a suction nozzle 11 and a housing 18. A tobacco tar cavity is formed in the housing 18. The tobacco tar in the tobacco tar cavity enters the atomization cotton 14, the atomization cotton 14 delivers the tobacco tar to the atomization surface of the piezoelectric ceramic being as an ultrasonic atomizing sheet for atomization, and the atomized smoke is sucked by a smoker through the air outflow passage of the suction nozzle.

The external thread of the housing 18 is connected with the suction nozzle 11. The suction nozzle 11 of the present invention can be removed for cleaning.

A side wall of the housing 18 is provided with an air inlet slot 30 which communicates with an air inlet of the silica gel seat 13.

Since the piezoelectric ceramic 14 of the present invention is placed obliquely, the smoke ejected when the piezoelectric ceramic 14 atomizes the tobacco tar is jetted onto the inner wall of the air outlet 39, so that the smoke droplets formed by the large-particle smoke drop onto the atomization cotton 14 along the inner wall and are recovered for re-atomization, and the smoke jetted from the piezoelectric ceramic 14 is prevented from directly impacting the user's mouth to produce bad experience such as tongue spiciness.

In addition, the two ends of the atomization cotton 14 of the present invention directly stretch into the tobacco tar cavity to directly contact the tobacco tar, so that the tobacco tar guide speed is higher when atomizing, and the atomization effect is better. At the same time, the piezoelectric ceramic 16 is placed obliquely, so the tobacco tar is not accumulated, and the atomization starting rate is improved.

Figure 5:
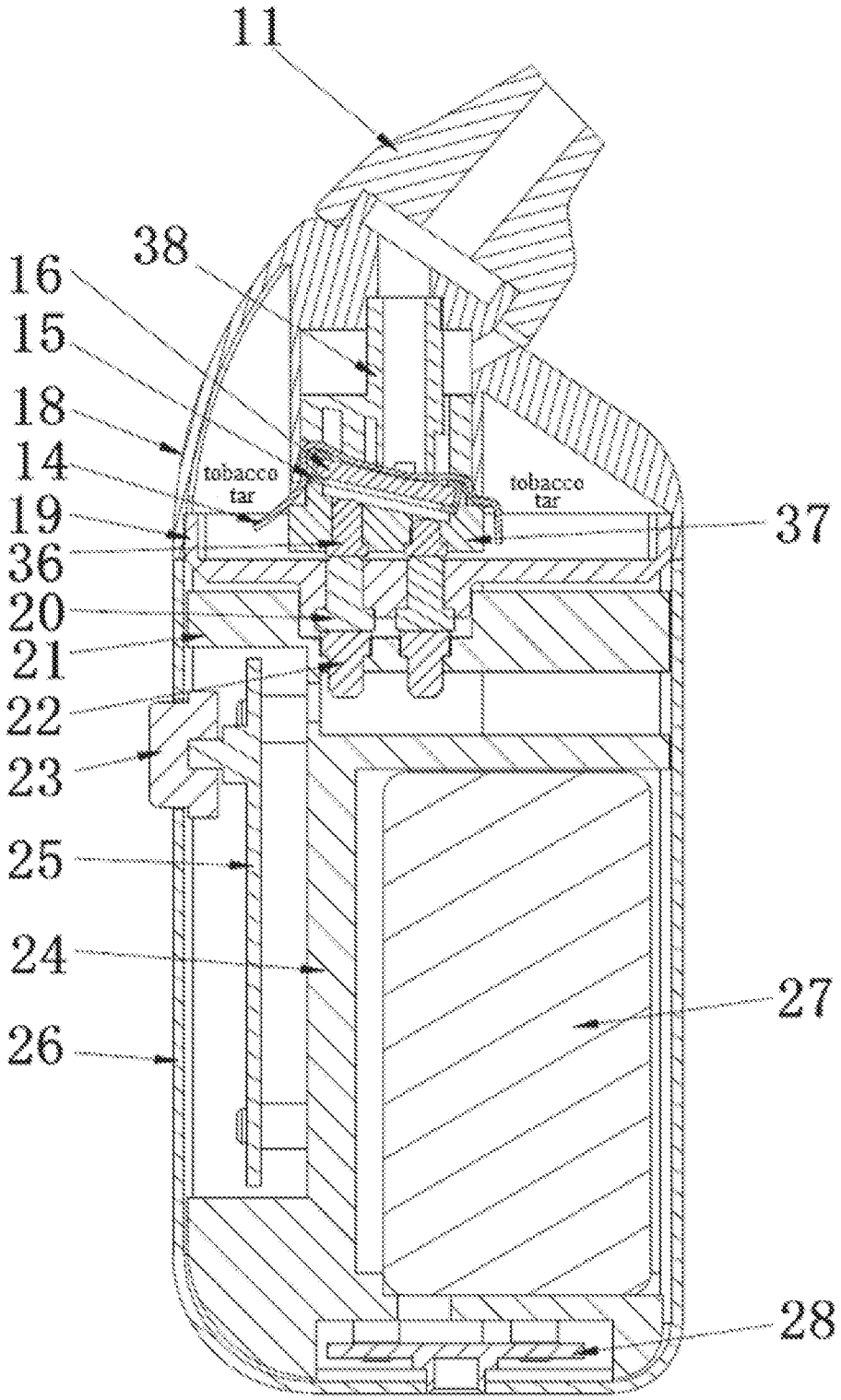
FIG. 5 is a structural principle diagram according to Embodiment 2 of the present invention.

An electronic cigarette, as shown in FIG. 5, includes the above atomizer 1 and a battery assembly 2, wherein the atomizer 1 is magnetically connected with the battery assembly 2 to facilitate disassembly.

The battery assembly of the present invention includes a battery cover 26, a large bracket 25, and a battery 27. A heat insulation space 29 is formed in the large bracket 25 to prevent the heat generated by the battery assembly 2 from being transferred to the battery cover 26 to scald hands when the electronic cigarette is in operation.

An upper fixing cover 19 is arranged at the bottom of the housing 18, a lower fixing cover 21 is arranged at the top of the battery cover 26, an upper electrode 20 is mounted on the upper fixing cover 19, a lower electrode 22 is mounted on the lower fixing cover 21, and the upper electrode 20 is electrically connected with the lower electrode 22. A key 23 is mounted on a side face of the battery cover 26, a PCB 24 is arranged inside the key 23, the battery 27 is electrically connected with the PCB 24, and the PCB 24 is in contact with the lower electrode 22 when the PCB 24 is pressed by the key 23, so that the battery 27 supplies power to the piezoelectric ceramic being as an ultrasonic atomizing sheet for ultrasonic atomization.

The present embodiment differs from Embodiment 1 in that:

1. The atomization cotton 14 is in direct contact with the tobacco tar, so that when the atomizer 1 is in operation, the tobacco tar guide rate is higher and the atomization effect is better.

2. The piezoelectric ceramic 16 is arranged in the tobacco tar cavity, and the piezoelectric ceramic 16 is placed obliquely. When the piezoelectric ceramic 16 is in operation, the smoke formed by atomization of the tobacco tar is jetted to the inner wall of the air outlet 39, the inner wall collects and condenses large-particle smoke into smoke droplets, and the smoke droplets drop onto the atomization cotton 14 along the inner wall and are re-atomized. During this process, small-particle smoke is sucked by the user, thus prevent the large-particle smoke from being sucked to affect the taste of the smoke.

3. The support pillar 41 is arranged on the atomizing seat 37, and abuts against the atomization cotton 14 to prevent the atomization cotton 14 from being separated from the piezoelectric ceramic 16 to affect the atomization effect.

The contents illustrated by the above embodiments should be understood as these embodiments are merely used for illustrating the present invention more clearly, rather than limiting the scope of the present invention. Various equivalent modifications made to the present invention by those skilled in the art after reading the present invention all fall within the scope defined by the appended claims of the present application.

The invention claimed is:

1. An atomizer, comprising a housing comprising a bottom which is arranged horizontally, an atomization cotton and an ultrasonic atomizing sheet, wherein the atomization cotton and the ultrasonic atomizing sheet are arranged in the housing, wherein the ultrasonic atomizing sheet is obliquely arranged in the housing with respect to the bottom, and two ends of the atomization cotton are used for connecting to tobacco tar in a tobacco tar cavity via tobacco tar guide cotton or the two ends of the atomization cotton are directly provided in the tobacco tar cavity, a bottom of the tobacco tar cavity is lower than the ultrasonic atomizing sheet, and a lower surface of the atomization cotton, which faces the ultrasonic atomizing sheet, is in contact with an atomization surface of the ultrasonic atomizing sheet.

2. The atomizer according to claim 1, wherein the ultrasonic atomizing sheet is a piezoelectric ceramic driven by an electric conductor to ultrasonically vibrate.

3. The atomizer according to claim 1, wherein the ultrasonic atomizing sheet has an inclination angle of A, wherein $0° < A < 90°$.

4. The atomizer according to claim 1, wherein:

the ultrasonic atomizing sheet is arranged in a mounting cavity of the housing, the mounting cavity is obliquely arranged, the ultrasonic atomizing sheet is arranged in the mounting cavity through a silica gel sleeve, a bottom of the mounting cavity is provided with a penetration groove, and a lower part of the atomization cotton penetrates through the penetration groove and is connected to the tobacco tar guide cotton.

5. The atomizer according to claim 4, wherein:

a locking ring fixedly connected with the housing is arranged at an upper part of the tobacco tar guide cotton, an air tube for communicating with a suction nozzle is formed in a center of the locking ring, an air passing slot is formed in an outer wall of the locking ring, and the air passing slot is used for forming an air inflow passage between the outside and the atomization cotton.

6. The atomizer according to claim 5, wherein a gap is formed between a bottom of the air tube of the locking ring and an upper surface of the atomization cotton, and wherein a width of the gap is 0.5 to 2.5 mm.

7. The atomizer according to claim 1, wherein a pressing structure which maintains contact between the atomization cotton and the atomization surface of the ultrasonic atomizing sheet is arranged on an upper surface of the atomization cotton and wherein the pressing structure is a pressing spring.

8. The atomizer according to claim 1, wherein:

the ultrasonic atomizing sheet is arranged at a top of an atomizing seat, a silica gel seat is arranged on an upper surface of the ultrasonic atomizing sheet, an air outlet is formed in a center of the silica gel seat, and an air inlet is formed at a lower part of the silica gel seat, wherein the air outlet is used for communicating with the suction nozzle, and the air inlet is used for forming an air inflow passage between the outside and the atomization cotton.

9. The atomizer according to claim 8, wherein a bottom of the silica gel seat is provided with a ventilation groove which is used for communicating the air outlet with the air inflow passage.

10. The atomizer according to claim 8, wherein the two ends of the atomization cotton pass through the gap between the atomizing seat and the silica gel seat and stretch into the tobacco tar cavity.

11. The atomizer of claim 1, further comprising a suction nozzle.

12. The atomizer according to claim 11, wherein:

a locking ring fixedly connected with the housing is arranged at an upper part of the tobacco tar guide cotton, the housing and the locking ring are detachably and fixedly connected, the housing and the suction nozzle are also detachably and fixedly connected, an internal thread of the housing is connected to an external thread of the locking ring, and the external thread of the housing is connected to the internal thread of the suction nozzle.

13. The atomizer according to claim 12, wherein:

an air tube is formed in a center of the locking ring, the air tube and a hollow passage of the suction nozzle form an air outflow passage, an air inlet slot is formed between the housing and the suction nozzle, an air passing slot is formed in an outer wall surface of the locking ring, and the air inlet slot and the air passing slot form an air inflow passage which communicates with the air outflow passage.

14. The atomizer according to claim 11, wherein the housing and the suction nozzle are detachably and fixedly connected, and the internal thread of the housing is connected to the external thread of the suction nozzle.

15. The atomizer according to claim 14, wherein:

a silica gel seat and an atomizing seat are arranged in the housing, the ultrasonic atomizing sheet and the atomization cotton are arranged between the silica gel seat and the atomizing seat, an air outlet is formed in a center of the silica gel seat, an air inlet is formed at a lower part of the silica gel seat, wherein the air outlet communicates with the suction nozzle to form an air outflow passage, and the air inlet and the ventilation groove arranged at a bottom of the silica gel seat form an air inflow passage which communicates with the air outflow passage.

16. An electronic cigarette, wherein the electronic cigarette comprises a battery assembly and the atomizer according to claim 11, wherein the battery assembly is used for driving the ultrasonic atomizing sheet to ultrasonically vibrate through a battery, and the ultrasonic atomizing sheet of the atomizer is obliquely arranged relative to the horizontal plane when the electronic cigarette is used.

17. The electronic cigarette according to claim 16, wherein the atomizer is detachably and fixedly connected to the battery assembly, and the atomizer is magnetically connected to the battery assembly.

18. The electronic cigarette according to claim 16, wherein the battery assembly comprises a battery cover, a large bracket and a battery and a heat insulation space is formed in the large bracket.

19. The electronic cigarette according to claim 18, wherein:

an upper fixing cover is arranged at the bottom of the housing, a lower fixing cover is arranged at a top of the battery cover, an upper electrode is mounted on the upper fixing cover, a lower electrode is mounted on the lower fixing cover, and the upper electrode is electrically connected with the lower electrode, wherein a key is mounted on a side face of the battery cover, a PCB is arranged inside the key, the battery is electrically connected with the PCB, and the PCB is in contact with the lower electrode when the PCB is pressed by the key.

20. The atomizer according to claim 1, where in the ultrasonic atomizing sheet has an inclination angle of A, wheein $50° \leq A \leq 75°$.

* * * * *